US011089663B2

(12) United States Patent
Nishigami et al.

(10) Patent No.: US 11,089,663 B2
(45) Date of Patent: Aug. 10, 2021

(54) LIGHT-EMITTING ELEMENT DRIVING DEVICE

(71) Applicant: Rohm Co., Ltd., Kyoto (JP)

(72) Inventors: Yoshito Nishigami, Kyoto (JP); Masaaki Nakayama, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 16/890,460

(22) Filed: Jun. 2, 2020

(65) Prior Publication Data

US 2020/0389961 A1 Dec. 10, 2020

(30) Foreign Application Priority Data

Jun. 5, 2019 (JP) ..... JP2019-104943

(51) Int. Cl.
*H05B 45/14* (2020.01)
*H05B 45/46* (2020.01)
*H05B 45/325* (2020.01)

(52) U.S. Cl.
CPC ..... *H05B 45/46* (2020.01); *H05B 45/14* (2020.01); *H05B 45/325* (2020.01)

(58) Field of Classification Search
CPC ..... H05B 45/10; H05B 45/14; H05B 45/30; H05B 45/325; H05B 45/46; H05B 45/52
See application file for complete search history.

(56) References Cited

U.S. PATENT DOCUMENTS 8,410,711 B2 * 4/2013 Lin ..... H05B 45/37 315/224
8,766,546 B2 * 7/2014 Oshima ..... H05B 45/50 315/185 R
9,468,055 B2 * 10/2016 Cheng ..... H05B 47/10
9,769,888 B2 * 9/2017 Wang ..... H05B 45/46
2005/0007085 A1 1/2005 Murakami
2007/0262796 A1 11/2007 Murakami
2008/0054815 A1 * 3/2008 Kotikalapoodi ..... H05B 45/46 315/192
2009/0128045 A1 * 5/2009 Szczeszynski ..... H05B 45/37 315/185 R
2009/0201002 A1 8/2009 Murakami
2010/0220049 A1 9/2010 Murakami
2010/0301762 A1 * 12/2010 Kung ..... G09G 3/3406 315/193
2011/0181582 A1 7/2011 Murakami
(Continued)

FOREIGN PATENT DOCUMENTS

JP 2005-033853 2/2005

*Primary Examiner* — Thai Pham
(74) *Attorney, Agent, or Firm* — Fish & Richardson P.C.

(57) ABSTRACT

A light-emitting element driving device includes: a first amplifier configured, with respect to each of a plurality of light-emitting element strings, to control a first transistor connected in series with the light-emitting element string based on the current passing through the light-emitting element string; and a second amplifier configured, with respect to each of at least part of the plurality of light-emitting element strings, a second transistor, which is included in a series circuit composed of the second transistor and a first resistor and connected in parallel with the first transistor, based on the current passing through the light-emitting element string and the current passing through the second transistor.

10 Claims, 13 Drawing Sheets

(56) References Cited

U.S. PATENT DOCUMENTS

| | | | | |
|---|---|---|---|---|
| 2013/0088174 | A1* | 4/2013 | Yagi | H05B 33/08 315/307 |
| 2013/0114016 | A1* | 5/2013 | Lim | H05B 45/46 349/43 |
| 2013/0314000 | A1 | 11/2013 | Murakami | |
| 2014/0132173 | A1* | 5/2014 | Zhang | H05B 45/37 315/224 |
| 2014/0346958 | A1 | 11/2014 | Murakami | |
| 2015/0028749 | A1* | 1/2015 | Sun | H05B 45/10 315/151 |
| 2016/0095181 | A1* | 3/2016 | Schiappelli | H05B 45/44 315/210 |
| 2016/0135262 | A1 | 5/2016 | Murakami | |
| 2017/0063226 | A1 | 3/2017 | Murakami | |
| 2018/0212518 | A1 | 7/2018 | Murakami | |
| 2019/0013730 | A1 | 1/2019 | Murakami | |
| 2019/0334437 | A1* | 10/2019 | Murakami | H02J 1/00 |

* cited by examiner

LIGHT-EMITTING ELEMENT DRIVING DEVICE

This nonprovisional application claims priority under 35 U.S.C. § 119(a) on Patent Application No. 2019-104943 filed in Japan on Jun. 5, 2019, the entire contents of which are hereby incorporated by reference.

BACKGROUND OF THE INVENTION

1. Field of the Invention

The invention disclosed in the present specification relates to light-emitting element driving devices.

2. Description of Related Art

There have conventionally been developed various light-emitting element driving devices for driving light-emitting elements such as LEDs (light-emitting diodes).

An example of a light-emitting device that includes a common LED driving device is shown in FIG. 12. The light-emitting device 200 shown in FIG. 12 has a plurality of sets of LEDs, that is, a plurality of LED strings Z1 to Zn, connected to the output terminal of a DC-DC converter CNV1.

In the light-emitting device 200 shown in FIG. 12, the DC-DC converter CNV1 is controlled by feeding back a feedback signal FB generated by a feedback control circuit FB1 such as a comparator or an amplifier to the DC-DC converter CNV1 such that, of the respective cathode voltages of the plurality of LED strings Z1 to Zn, the lowest remains a voltage equal to or higher than a predetermined value. This is because, if the cathode voltage of an LED string becomes lower than the desired current multiplied by the composite resistance of the on-state resistance of the transistor that is serially connected to that LED string to function as a current source and the current sense resistor that is connected in series with that transistor, it is no longer possible to pass the desired current through that LED string. In a case where, for example, only a small number of LED strings are provided and the variations among the respective forward voltages of the LED strings are small, it is possible to omit the feedback control circuit FB1 such as a comparator or an amplifier and instead to keep the output voltage fixed with no feedback returned.

Japanese Unexamined Patent Application Publication No. 2005-33853 discloses a device similar to the light-emitting device 200 shown in FIG. 12.

As the respective forward voltages of the LED strings Z1 to Zn vary, so do the respective cathode voltages of the LED strings Z1 to Zn. As a result, in the light-emitting device 200 shown in FIG. 12, an excessive voltage can be applied to the transistor that is connected in series with an LED string with a high cathode voltage, resulting in high power consumption in the transistor receiving the excessive voltage and hence more-than-necessary heat generation there.

SUMMARY OF THE INVENTION

According to one aspect of what is disclosed in the present specification, a light-emitting element driving device configured to drive a plurality of light-emitting element strings each composed of at least one light-emitting element includes: a first amplifier configured, with respect to each of the plurality of light-emitting element strings, to control a first transistor connected in series with the light-emitting element string based on the current passing through the light-emitting element string; and a second amplifier configured, with respect to each of at least part of the plurality of light-emitting element strings, to control a second transistor, which is included in a series circuit composed of the second transistor and a first resistor and connected in parallel with the first transistor, based on the current passing through the light-emitting element string and the current passing through the second transistor.

According to another aspect of what is disclosed in the present specification, a light-emitting device includes: a light-emitting element driving device configured as described above; and the plurality of light-emitting element strings.

According to yet another aspect of what is disclosed in the present specification, an electronic appliance includes a light-emitting device configured as described above.

The significance and effect of the present invention will become clear from the description of embodiments that follows. It should however be understood that the embodiments disclosed in the present specification are merely examples of how the present invention can be implemented, and that the meanings of the terms referring to various elements and features of the present invention are not limited to those in which those terms are used in the following description of embodiments.

DETAILED DESCRIPTION OF PREFERRED EMBODIMENTS

In the present description, a constant voltage denotes a voltage that remains constant under ideal conditions, and is a voltage that can in reality vary slightly with variation in temperature and the like.

In the present description, a MOS transistor denotes a field-effect transistor of which the gate has a structure composed of at least three layers, namely a "layer of a conductor or a semiconductor with a low resistance value", a "layer of an insulator", and a "layer of a semiconductor of a P-type, an N-type, or an intrinsic type. That is, the structure of the gate of a MOS transistor is not limited to the three-layer structure composed of a metal, an oxide, and a semiconductor.

In the present description, a reference voltage denotes a voltage that remains constant under ideal conditions, and is a voltage that can in reality vary slightly with variation in temperature and the like.

In the present description, a constant current denotes a current that remains constant under ideal conditions, and is a current that can in reality vary slightly with variation in temperature and the like.

Figure 1:
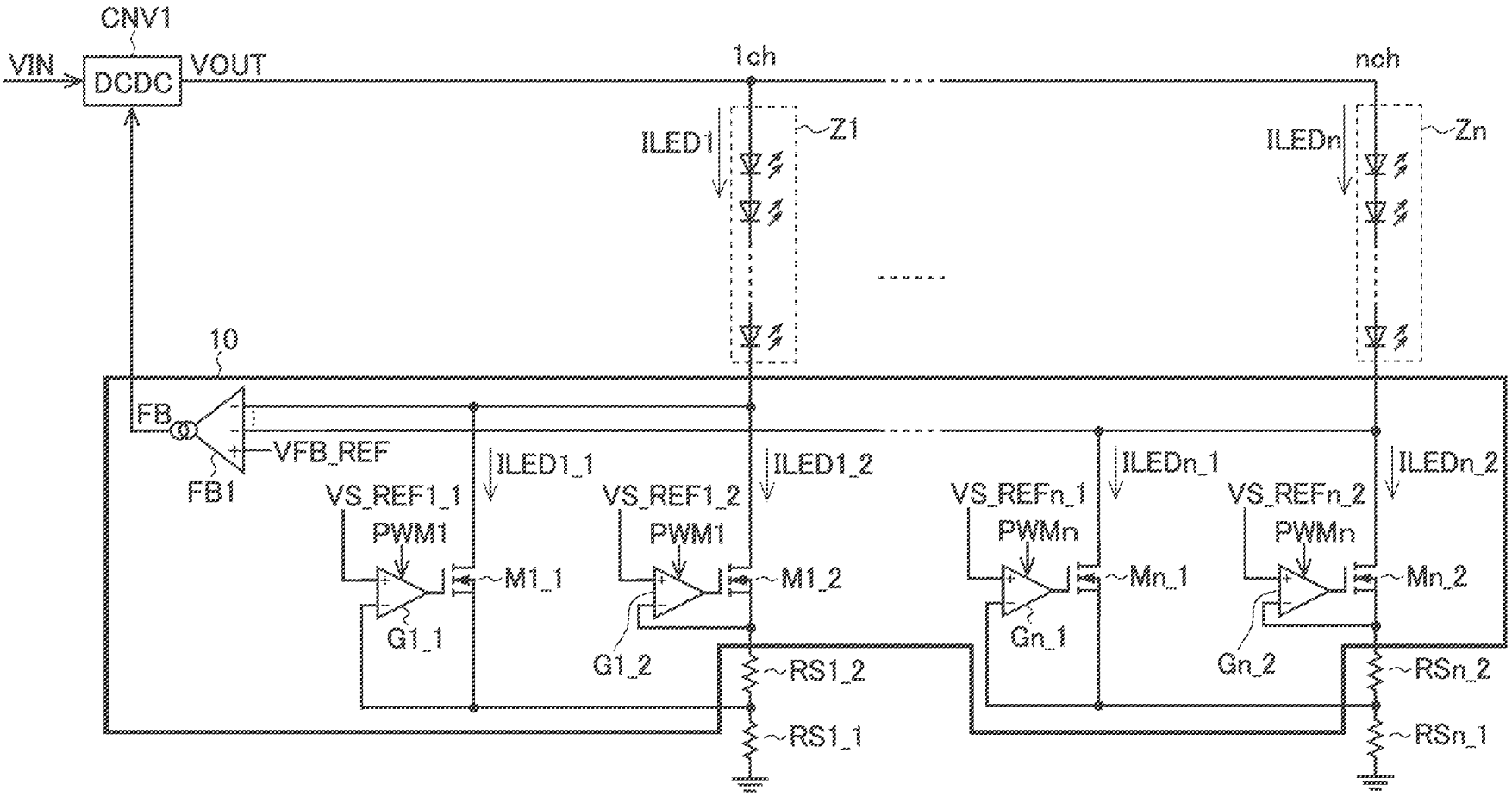
FIG. 1 is a diagram showing one configuration example of a light-emitting device.
Figure 12:
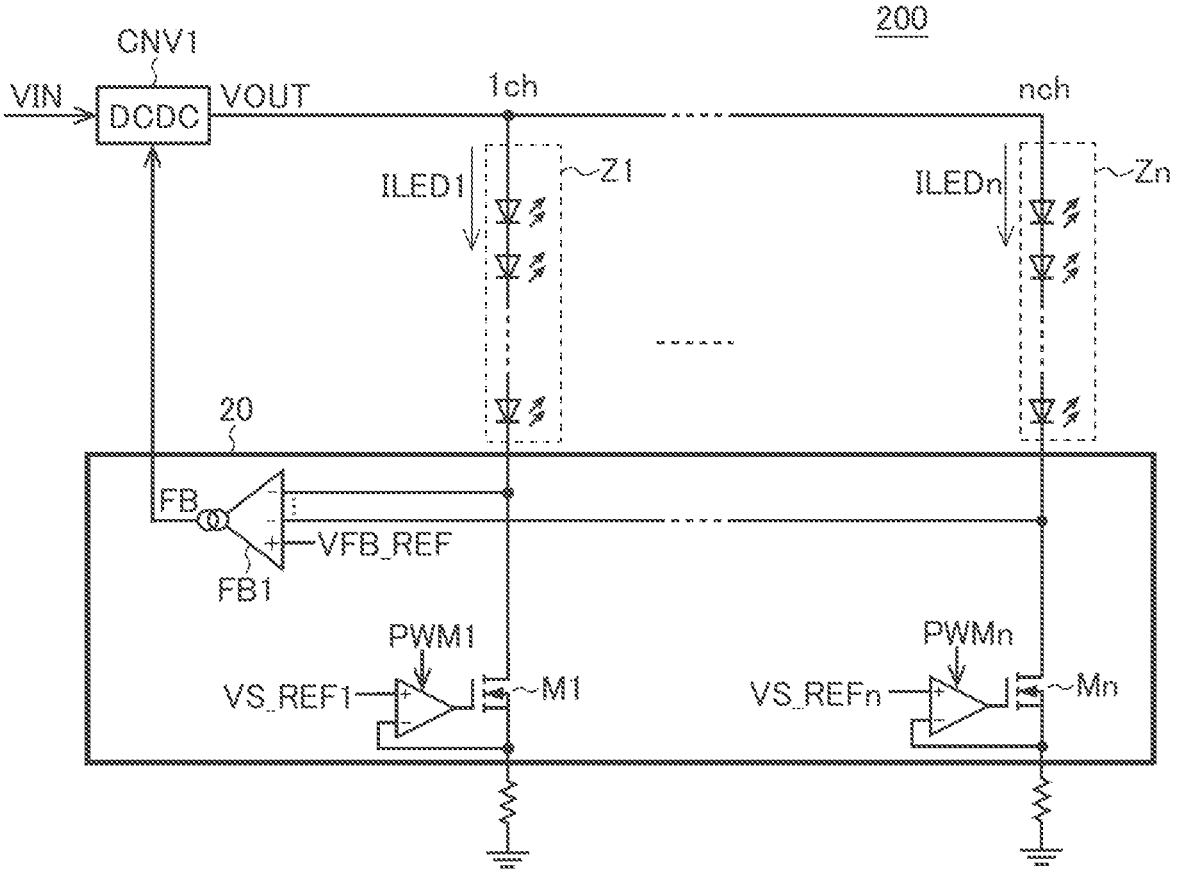
RELATED ART FIG. 12
FIG. 12 is a diagram showing one example of a light-emitting device including a common LED driving device.

One Configuration Example of a Light-Emitting Device: FIG. 1 is a diagram showing one configuration example of a light-emitting device. In FIG. 1, those parts which have their counterparts in FIG. 12 are identified by the same reference signs.

The light-emitting device 100 shown in FIG. 1 includes n sets of LEDs, that is, n LED strings Z1 to Zn, a DC-DC converter CNV1, an LED driving device 10, and resistors RS1_1 to RSn_1 and RS1_2 to RSn_2. Here, n is an integer of two or more.

The LED strings Z1 to Zn are each composed of at least one LED. The respective anodes of the LED strings Z1 to Zn are connected to the output terminal of the DC-DC converter CNV1.

The DC-DC converter CNV1 converts an input voltage VIN, which is fed to the input terminal of the DC-DC converter CNV1, into an output voltage VOUT to output the output voltage VOUT via the output terminal of the DC-DC converter CNV1. The input voltage VIN and the output voltage VOUT are each a direct-current voltage. The power supply device that supplies the LED strings Z1 to Zn with electric power is not limited to a DC-DC converter; instead. any power supply device other than a DC-DC converter can be used.

The DC-DC converter CNV1 converts the input voltage VIN into the output voltage VOUT based on the feedback signal FB fed from the LED driving device 10. Usable as the DC-DC converter CNV1 is, for example, a boosting chopper circuit that includes an inductor, a switching element, a diode, a smoothing capacitor, and a power IC that controls the switching of the switching element. In a variation of this embodiment, the power IC can instead be incorporated in the LED driving device 10. In a case where the power IC is incorporated in the LED driving device 10, the LED driving device 10 outputs not a feedback signal but a switching control signal.

The LED driving device 10 is an LED driver IC, and includes a feedback control circuit FB1 such as a comparator or an amplifier, NMOS transistors M1_1 to Mn_1 and M1_2 to Mn_2, operational amplifiers G1_1 to Gn_1 and G1_2 to Gn_2, a reference voltage generation circuit (not shown) and a PWM signal generation circuit (not shown). In a variation of this embodiment, the reference voltage can be generated outside the LED driving device 10. In another variation of this embodiment, the PWM signal can be generated outside the LED driving device 10.

The reference voltage generation circuit generates reference voltages VFB_REF, VS_REF1_1 to VS_REFn_1, and VS_REF1_2 to VS_REFn_2. The PWM signal generation circuit generates PWM signals PWM1 to PWMn.

Resistors RS1_1 to RSn_1 and RS1_2 to RSn_2 are externally connected to the LED driving device 10.

The feedback control circuit FB1 such as a comparator or an amplifier outputs, as the feedback signal FB, a current signal that is commensurate with the difference between the lowest voltage among the respective cathode voltages of the LED strings Z1 to Zn and the reference voltage VFB_REF. In a case such as where only a small number of LED strings are provided and the variations among the respective forward voltages of the LED strings is small, it is possible to omit the feedback control circuit FB1 such as a comparator or an amplifier and instead to keep the output voltage VOUT fixed with no feedback returned. While this embodiment deals with a configuration where the cathode of the LED string Zk is connected to the anode of the constant current source that passes the constant current ILEDk, the opposite configuration is also possible: the anode of the LED string Zk can instead be connected to the cathode of the constant current source that passes the constant current ILEDk. In a light-emitting device with a configuration where the anode of the LED string Zk is connected to the cathode of the constant current source that passes the constant current ILEDk, a feedback control circuit such as a comparator or an amplifier can output, as the feedback signal FB, a current signal that is commensurate with the difference between the highest voltage among the respective anode voltages of the LED strings Z1 to Zn and the reference voltage VFB_REF.

The drains of the NMOS transistors Mk_1 and Mk_2 are connected to the cathode of the LED string Zk. The source of the NMOS transistor Mk_1 is connected to one terminal of the resistor RSk_1, and the source of the NMOS transistor Mk_2 is connected via the resistor RSk_2 to one terminal of the resistor RSk_1. The other terminal of the resistor RSk_1 is connected to a ground potential. Here, k is a natural number equal to or smaller than n.

The operational amplifier Gk_1 controls the gate voltage of the NMOS transistor Mk_1 based on the difference between the potential difference across the resistor RSk_1 and the reference voltage VS_REFk_1. Here, through the resistor RS_k1 passes a current equivalent to the current that passes through the LED string Zk. Accordingly, the operational amplifier Gk_1 controls the NMOS transistor Mk_1 based on the current that passes through the LED string Zk.

The operational amplifier Gk_2 controls the gate voltage of the NMOS transistor Mk_2 based on the difference between the sum of the potential difference across the resistor RSk_2 and the potential difference across the resistor RSk_1 and the reference voltage VS_REFk_2. Here, through the resistor RSk_2 passes a current equivalent to the current that passes through the NMOS transistor Mk_2, and through the resistor RSk_1 passes a current equivalent to the current that passes through the LED string Zk. Accordingly, the operational amplifier Gk_2 controls the NMOS transistor Mk_2 based on the current that passes through the NMOS transistor Mk_2 and the current that passes through the LED string Zk.

The operational amplifiers Gk_1 and Gk_2 perform PWM driving in accordance with the PWM signal PWMk. While the PWM signal PWMk is fed to the operational amplifiers Gk_1 and Gk_2, when the PWM signal PWMk is at high level, the operational amplifiers Gk_1 and Gk_2 keep the NMOS transistors Mk_1 and Mk_2 on and, when the PWM signal PWMk is at low level, the operational amplifiers Gk_1 and Gk_2 keep the NMOS transistors Mk_1 and Mk_2 off. Accordingly, the LED string Zk is subject to dimming based on the on-duty of the PWM signal PWMk. In an opposite variation of this embodiment, the operational amplifiers Gk_1 and Gk_2 can, when the PWM signal PWMk is at low level, keep the NMOS transistors Mk_1 and Mk_2 on and, when the PWM signal PWMk is at high level, keep the NMOS transistors Mk_1 and Mk_2 off. On the other hand, while the PWM signals PWMk are not fed to the operational amplifiers Gk_1 and Gk_2, the LED string Zk is kept extinguished.

The light-emitting device 100 shown in FIG. 1 can restrain heat generation in the NMOS transistors Mk_1 to Mk_2 by consuming electric power in the resistor RSk_2 in those (n−1) channels in which the cathode voltage of the LED string is not at the minimum voltage.

Now, a description will be given of an example where, of the respective cathode voltages of the LED strings Z1 to Zn, the cathode voltage of the LED string Z1 is the lowest.

Figure 2:
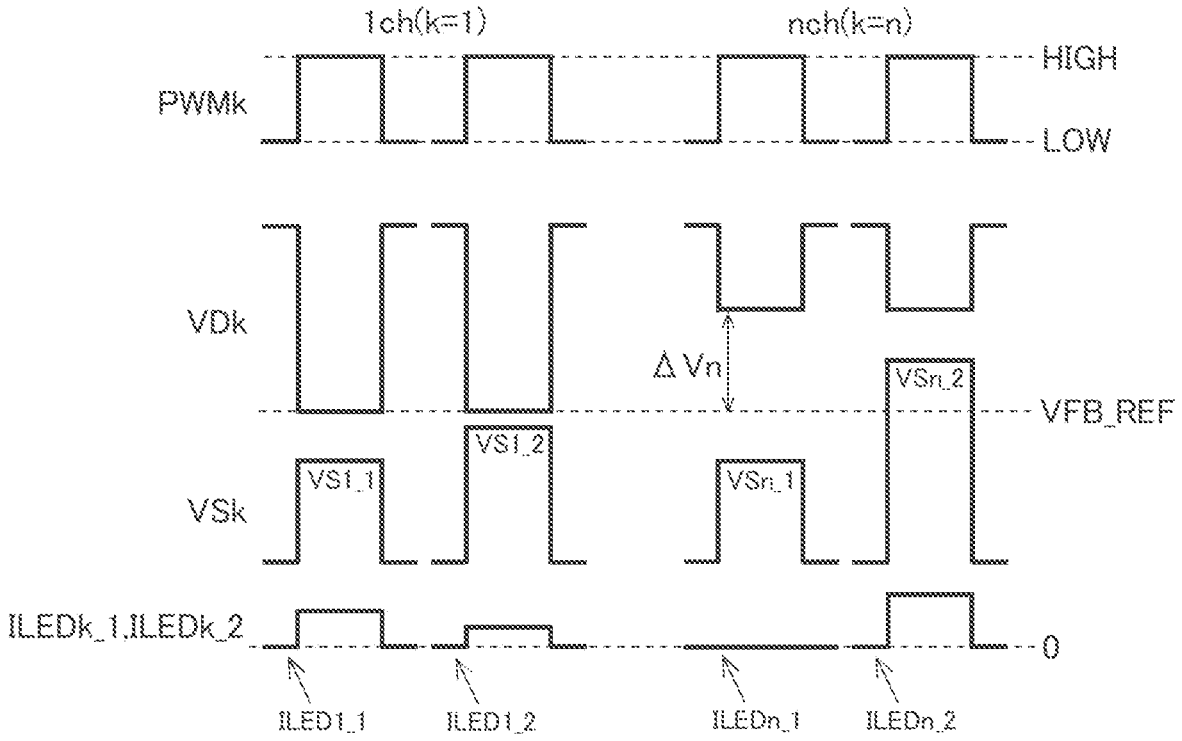
FIG. 2 is a diagram showing an outline of voltages and currents in the light-emitting device shown in FIG. 1.

FIG. 2 is a diagram showing an outline of voltages and currents in the 1st and nth channels in the light-emitting device 100 shown in FIG. 1. In the diagram, VDk represents the drain voltage of the NMOS transistor Mk_1; VSk represents the source voltages of the NMOS transistors Mk_1 and Mk_2; and ΔVn represents the voltage difference between the drain voltage of the NMOS transistor Mn_1 and the reference voltage VFB_REF.

For example, consider a case where, in the light-emitting device 100 shown in FIG. 1, the set value of each of the currents LED1 to LEDn that pass through the LED strings Z1 to Zn respectively is 300 mA, the resistance value of each of the resistors RS1_1 to RSn_1 and RS1_2 to RSn_2 is 2Ω, the reference voltage VFB_REF is 0.9 V, the on-duty of the PWM signals PWMk is so set that the operational amplifiers GK_1 and GK_2 are on all the time, and a voltage difference ΔVn of 600 mV occurs.

In this case, let us study what extent the total power consumption by the NMOS transistor Mn_1 and Mn_2 increases compared with the total power consumption by the NMOS transistors M1_1 and M1_2. In the 1st channel, the voltage difference between the drain voltage of the NMOS transistor M1_1 and the reference voltage VFB_REF is zero and the minimum value of the on-state resistance of each of the NMOS transistors M1_1 and M1_2 is 1Ω; thus, when the reference voltage VS_REFk_2 is set to be twice the reference voltage VS_REFk_1, then the current ILED1_1 that passes through the NMOS transistor M1_1 is 200 mA and the current ILED1_2 that passes through the NMOS transistor M1_2 is 100 mA. The power consumption by the NMOS transistor M1_1 is 0.06 W and the power consumption by the NMOS transistor M1_2 is 0.01 W; thus, the total power consumption by the NMOS transistors M1_1 and M1_2 is 0.07 W. In the nth channel, the voltage difference ΔVn between the drain voltage of the NMOS transistor Mn_1 and the reference voltage VFB_REF is 0.6 V, the current ILEDn_1 that passes through the NMOS transistor Mn_1 is zero, and the current ILEDn_2 that passes through the NMOS transistor Mn_2 is 300 mA. The power consumption by the NMOS transistor Mn_1 is zero and the power consumption by the NMOS transistor Mn_2 is 0.09 W; thus the total power consumption by the NMOS transistors Mn_1 and Mn_2 is 0.09 W. Accordingly, the total power consumption by the NMOS transistors Mn_1 and Mn_2 is, as compared with the total power consumption by the NMOS transistors M1_1 and M1_2, higher by 0.02 W (=0.09 W−0.07 W).

Figure 13:
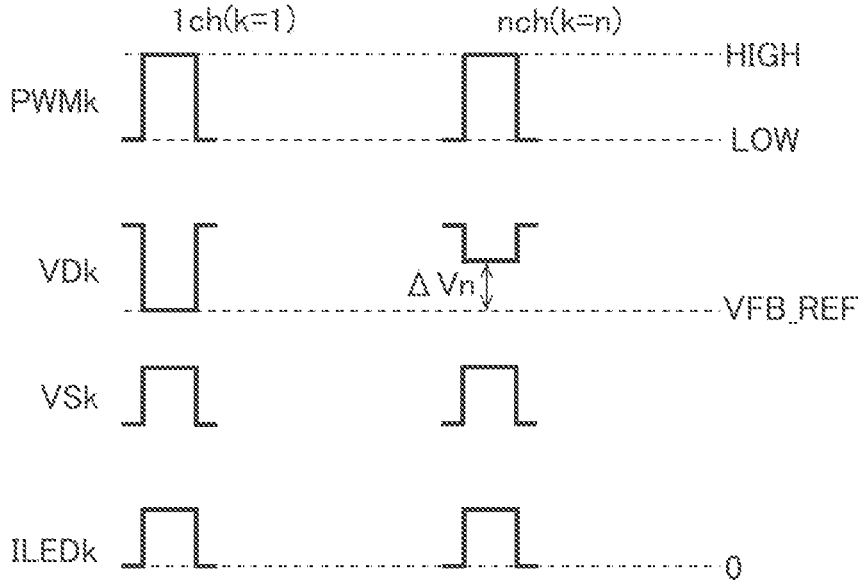
RELATED ART FIG. 13
FIG. 13 is a diagram showing an outline of voltages and currents in the light-emitting device shown in FIG. 12.

On the other hand, FIG. 13 is a diagram showing an outline of voltages and currents in the 1st and nth channels in the light-emitting device 200 shown in FIG. 12. In the diagram, VDk represents the drain voltage of the NMOS transistor Mk; VSk represents the source voltage of the NMOS transistor Mk; and ΔVn represents the voltage difference between the drain voltage of the NMOS transistor Mn and the reference voltage VFB_REF.

For example, consider a case where, in the light-emitting device 200 shown in FIG. 12, the set value of each of the currents LED1 to LEDn that pass through the LED strings Z1 to Zn respectively is 300 mA and a voltage difference ΔVn of 600 mV occurs.

In that case, the current LEDn that passes through the LED string Zn all passes through the NMOS transistor Mn; thus, the power consumption by the NMOS transistor Mn is, as compared with the power consumption by the NMOS transistor M1, higher by 0.18 W (=0.3 A×0.6V).

Comparing the cases considered above reveals the following: in the light-emitting device 100 shown in FIG. 1, the extra heat generated in the nth channel as compared with in the 1st channel is dispersed to the resistor RSn_2; thus, the increase in the total power consumption (heat generation) in the NMOS transistors Mn_1 and Mn_2 is reduced to about one tenth (=0.02/0.18) of the increase in the total power consumption (heat generation) in the NMOS transistor Mn in the light-emitting device 200 shown in FIG. 12.

Figure 3:
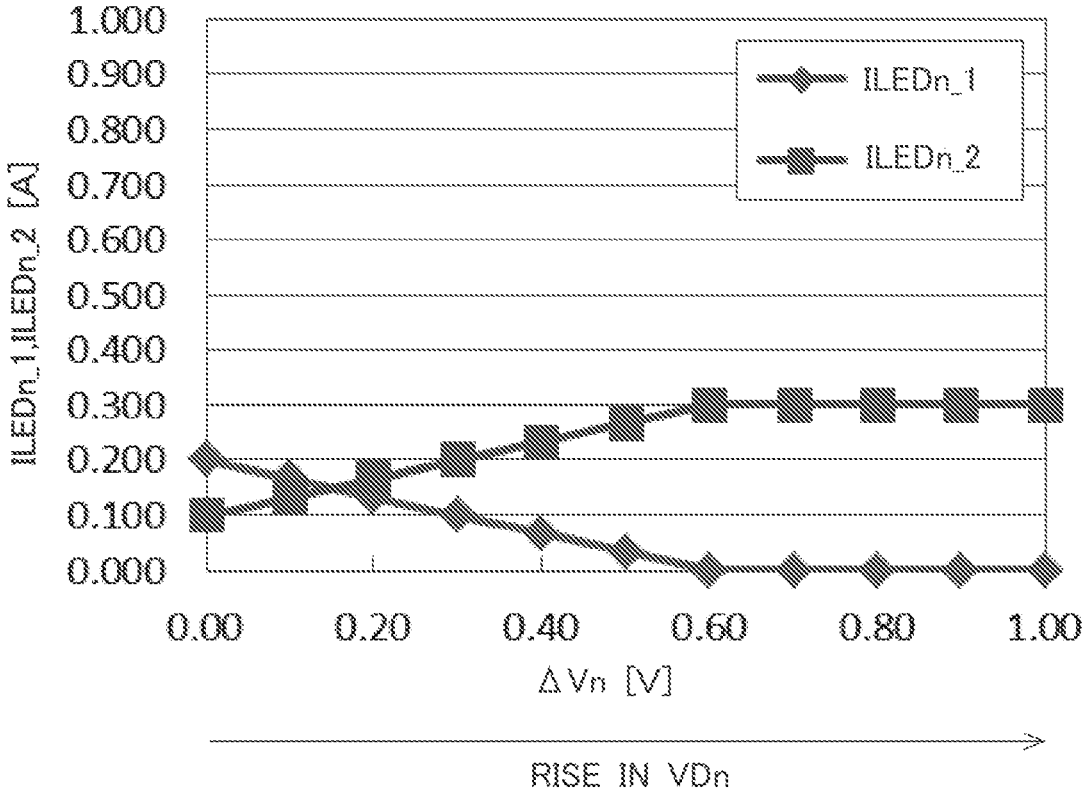
FIG. 3 is a diagram showing current characteristics of the light-emitting device shown in FIG. 1.

As studied above, as the drain voltage VDn of the NMOS transistor Mn_1 increases, for example as shown in FIG. 3, the current ILEDn_2 that passes through the resistor RSn_2 increases and the current ILEDn_1 that passes through the NMOS transistor Mn_1 decreases. When the drain voltage VDn of the NMOS transistor Mn_1 increases until the voltage difference ΔVn becomes equal to or higher than a predetermined value P1, no current passes through the NMOS transistor Mn_1 any longer, and a current passes only through the resistor RSn_2. When no current passes through the NMOS transistor Mn_1, heat generation is dispersed to the NMOS transistor Mn_2 and the resistor RSn_2. This helps reduce, as compared with the increase in the power consumption (heat generation) by the NMOS transistor Mn in the light-emitting device 200 shown in FIG. 12, the increase in the power consumption (heat generation) by the NMOS transistors Mn_1 and Mn_2. The same is true with the NMOS transistors M2_1 to M(n−1)_1 and M2_2 to M(n−1)_2.

While the predetermined value P1 is 0.60 V in the example shown in FIG. 3, the predetermined value P1 can be changed by adjusting the ratio between the resistance values of the resistors RSn_1 and RSn_2.

In the example shown in FIG. 3, the resistance values of the resistors RSk_1 and RSk_2 can be made equal, the reference voltage VS_REFk_2 can be set at twice the reference voltage VS_REFk_1, and the required control is easy. On the other hand, in a case where, as in the 1st channel shown in FIG. 2, the voltage difference ΔVn is 0, the current ILEDn_2 that passes through the resistor RSn_2 can be set at approximately zero. Whether the current ILEDn_2 becomes zero depends on the drain potential of the NMOS transistor Mn_2. Accordingly, through the setting of the reference voltage VFB_REF by the feedback control circuit and with the resistors RSn_1 and RSn_2 and the on-state resistance of the NMOS transistor Mn_2, it is possible to make an adjustment such that, when the voltage difference ΔVn is zero, the current ILEDn_2 that passes through the resistor RSn_2 is approximately zero.

A configuration is possible where the LED driving device 10 acquires information on the ratio between the resistance values of the resistors RSk_1 and RSk_2 by, for example, SPI communication and, based on that information, a reference voltage generator provided within the LED driving device 10 sets the values of the resistance values VS_REFk_1 and VS_REFk_2.

Figure 4:
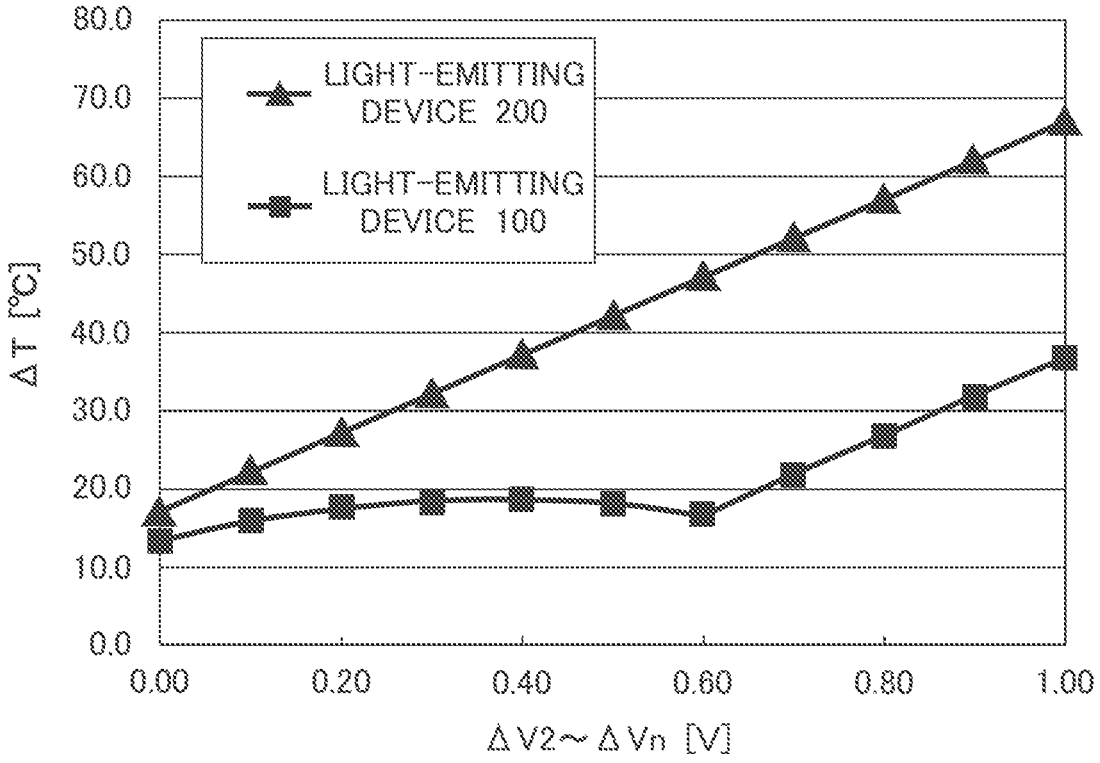
FIG. 4 is a diagram showing temperature rise characteristics of the light-emitting device shown in FIG. 1.

In the light-emitting device 100 shown in FIG. 1, through the heat dispersion mentioned above, the heat generation in the LED driving device 10 can be reduced. FIG. 4 is a diagram showing the temperature rise characteristics of the LED driving device 10 provided in the light-emitting device 100 shown in FIG. 1 and the temperature rise characteristics of an LED driving device 20 provided in the light-emitting device 200 shown in FIG. 12. FIG. 4 shows, as an example, the temperature rise characteristics observed in a case where the number of channels, i.e., n, is eight; of the respective cathode voltages of the LED strings Z1 to Z8, the cathode voltage of the LED string Z1 is the lowest; the set value of each of the currents LED1 to LED8 that pass through the LED strings Z1 to Z8 is 300 mA; the resistors Rsk, RSk_1, and RSk_2 each have a resistance value of 2Ω; the reference voltage VFB_REF is 0.9 V; the operational amplifiers Gk, Gk_1, and Gk_2 are on all the time; the thermal resistance is 23.7° C./W; the minimum on-state resistance of each NMOS transistor is 0.5Ω in the light-emitting device 200 and 1Ω in the light-emitting device 100; the reference voltage VS_REFk_2 is set at twice the reference voltage VS_REFk_1; and voltage differences ΔV2 to ΔVn (where n=8) occur among the LED strings Z2 to Z8. In this example, the light-emitting device 200 uses one NMOS transistor per channel, and the light-emitting device 100 uses two NMOS transistors per channel; thus, to make equal the total area of the NMOS transistors in the light-emitting device 200 and that in the light-emitting device 100, in the light-emitting device 100, the on-state resistance of each NMOS transistors is doubled and the area of each NMOS transistor is halved.

Modified Examples of Light-Emitting Devices: FIGS. 7 to 11 show a first to a fifth modified example of light-emitting devices.

Figure 7:
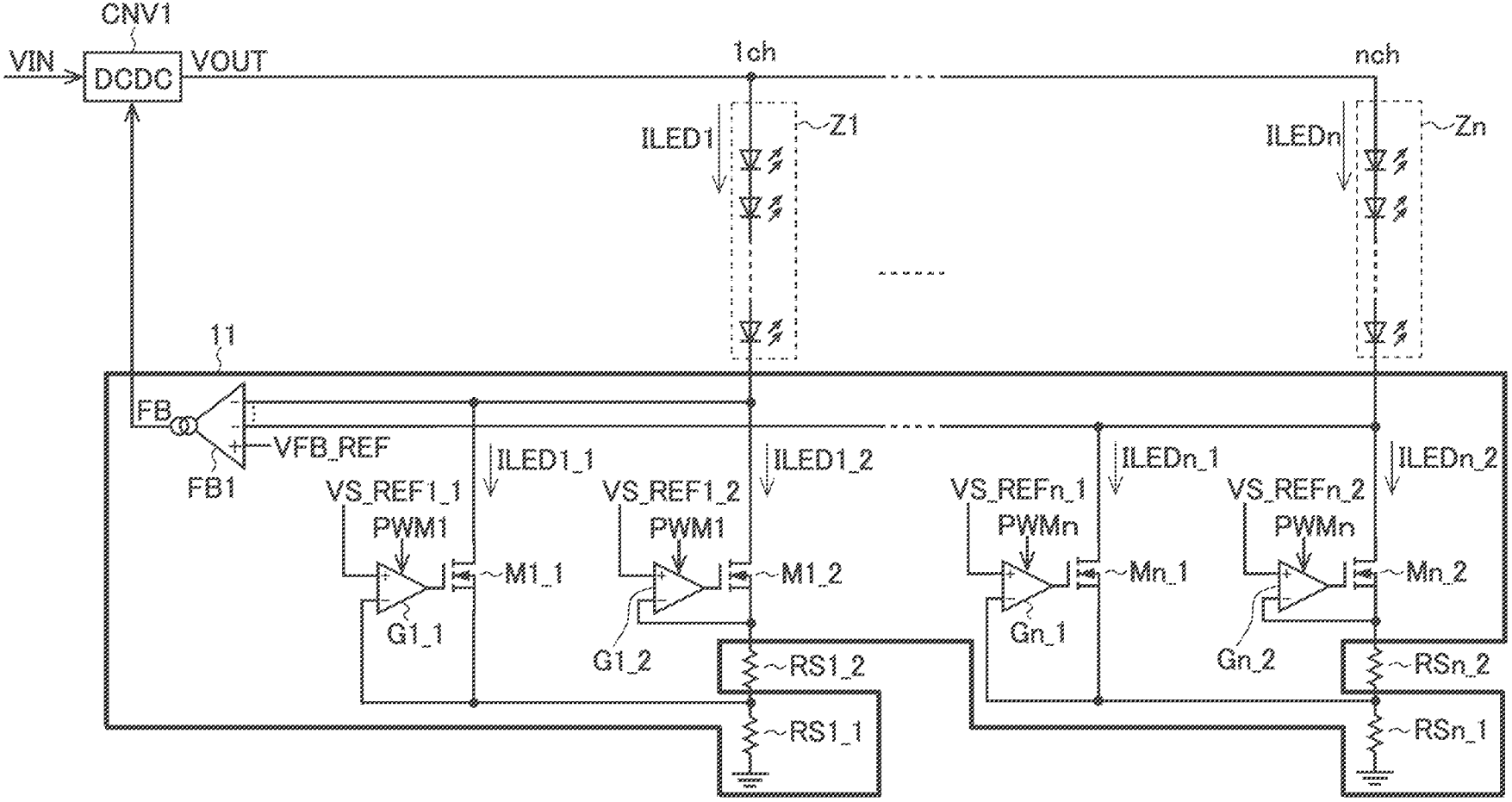
FIG. 7 is a diagram showing a first modified example of a light-emitting device.

The light-emitting device 101 shown in FIG. 7 includes an LED driving device 11. The LED driving device 11 differs from the LED driving device 10 in that it includes the resistors RS1_2 to RSn_2. In the light-emitting device 101 shown in FIG. 7, the resistors RS1_2 to RSn_2 are incorporated in the LED driving device 11, and this helps reduce the number of components as compared with the light-emitting device 100 shown in FIG. 1. In a variation of the configuration shown in FIG. 7, the resistors RS1_2 to RSn_2 can be components that are externally connected to an LED driving device and the resistors RS1_1 to RSn_1 can be incorporated in the LED driving device.

Figure 8:
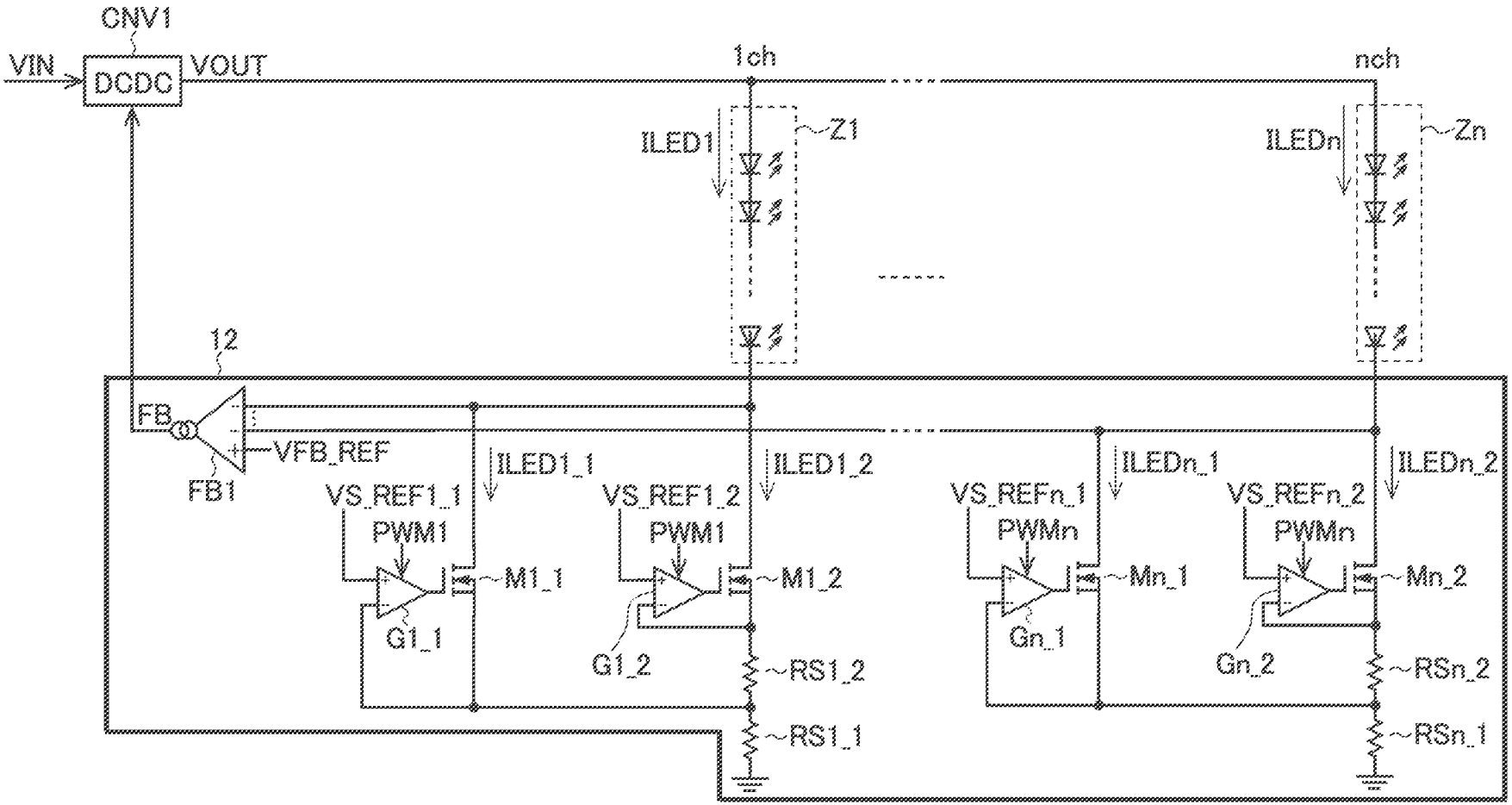
FIG. 8 is a diagram showing a second modified example of a light-emitting device.

The light-emitting device 102 shown in FIG. 8 includes an LED driving device 12. The LED driving device 12 differs from the LED driving device 11 in that it includes the resistors RS1_1 to RSn_1. In the light-emitting device 102 shown in FIG. 8, the resistors RS1_1 to RSn_1 are incorporated in the LED driving device 12, and this helps reduce the number of components as compared with the light-emitting device 101 shown in FIG. 7.

Figure 9:
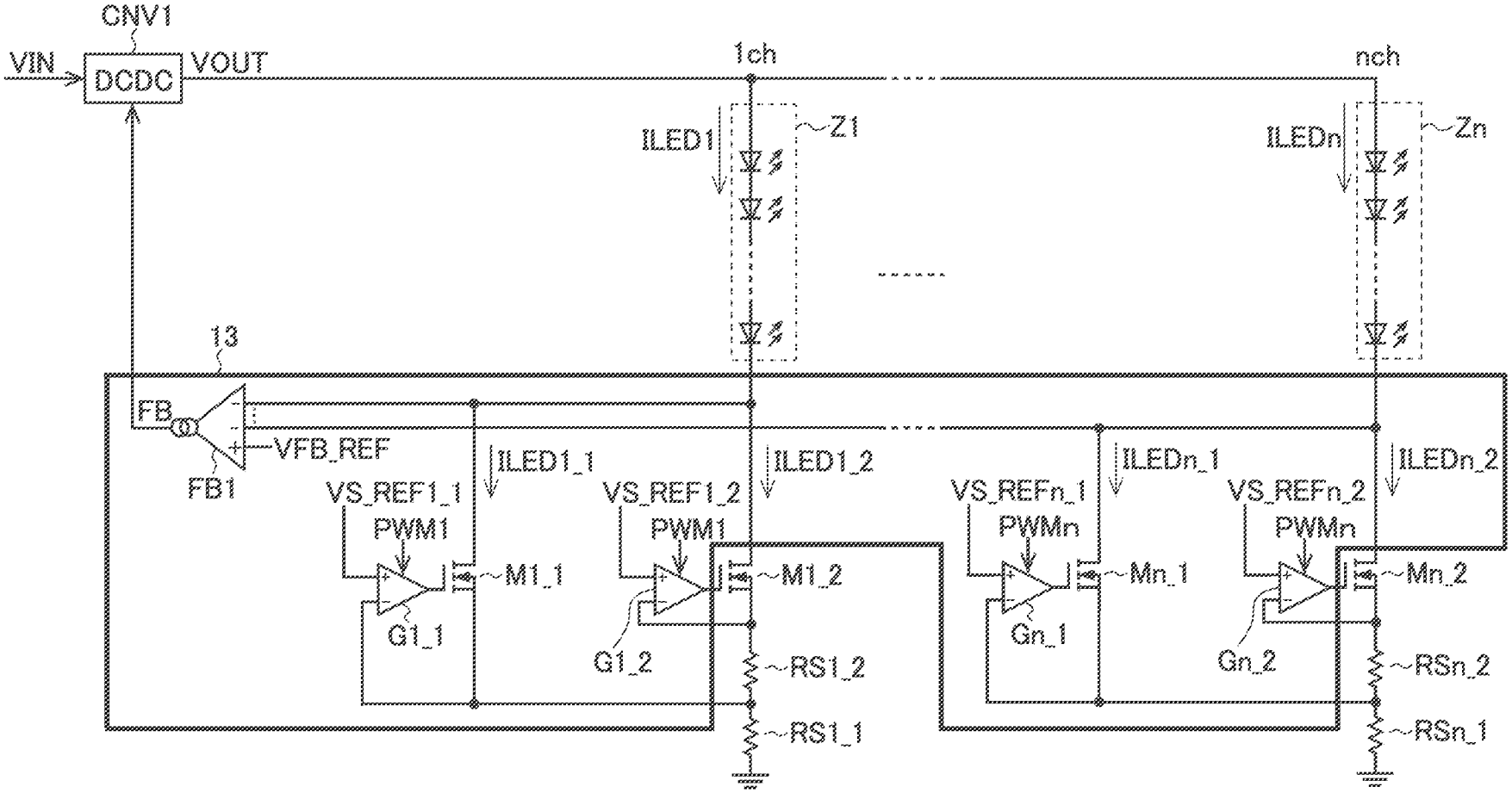
FIG. 9 is a diagram showing a third modified example of a light-emitting device.

The light-emitting device 103 shown in FIG. 9 includes an LED driving device 13. The LED driving device 13 differs from the LED driving device 10 in that it does not include the NMOS transistors M1_2 to Mn_2. In the light-emitting device 103 shown in FIG. 9, the NMOS transistors M1_2 to Mn_2 are components that are externally connected to the LED driving device 13, and this helps effectively restrain the rise in the temperature of the LED driving device 13 in a case where the variations among the cathode voltages of the LED strings in the different channels are comparatively large.

Figure 10:
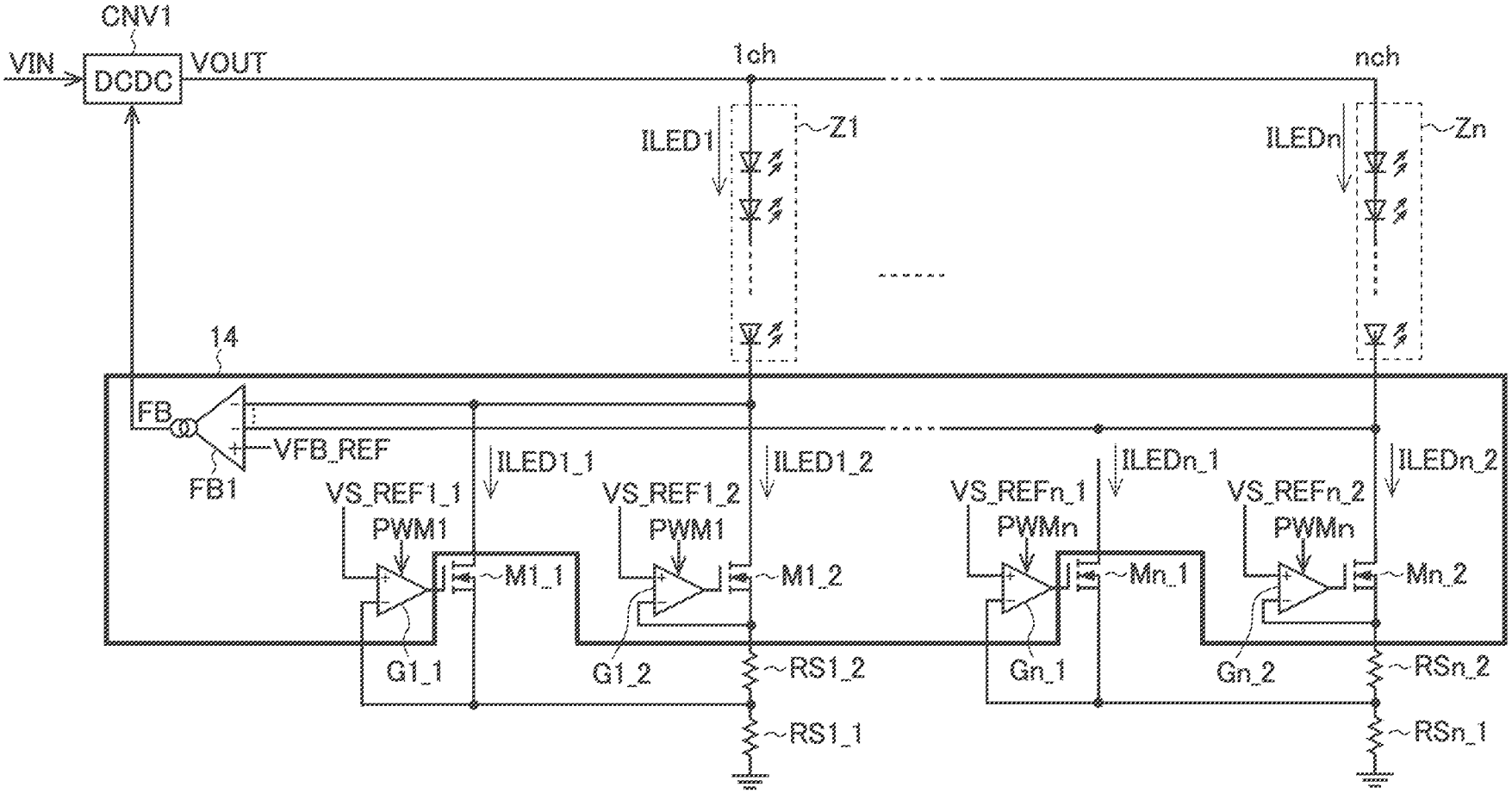
FIG. 10 is a diagram showing a fourth modified example of a light-emitting device.

The light-emitting device 104 shown in FIG. 10 includes an LED driving device 14. The LED driving device 14 differs from the LED driving device 10 in that it does not include the NMOS transistors M1_1 to Mn_1. In the light-emitting device 104 shown in FIG. 10, the NMOS transistors M1_1 to Mn_1 are components that are externally connected to the LED driving device 14, and this helps effectively restrain the rise in the temperature of the LED driving device 14 in a case where the variations among the cathode voltages of the LED strings in the different channels are comparatively small.

Figure 11:
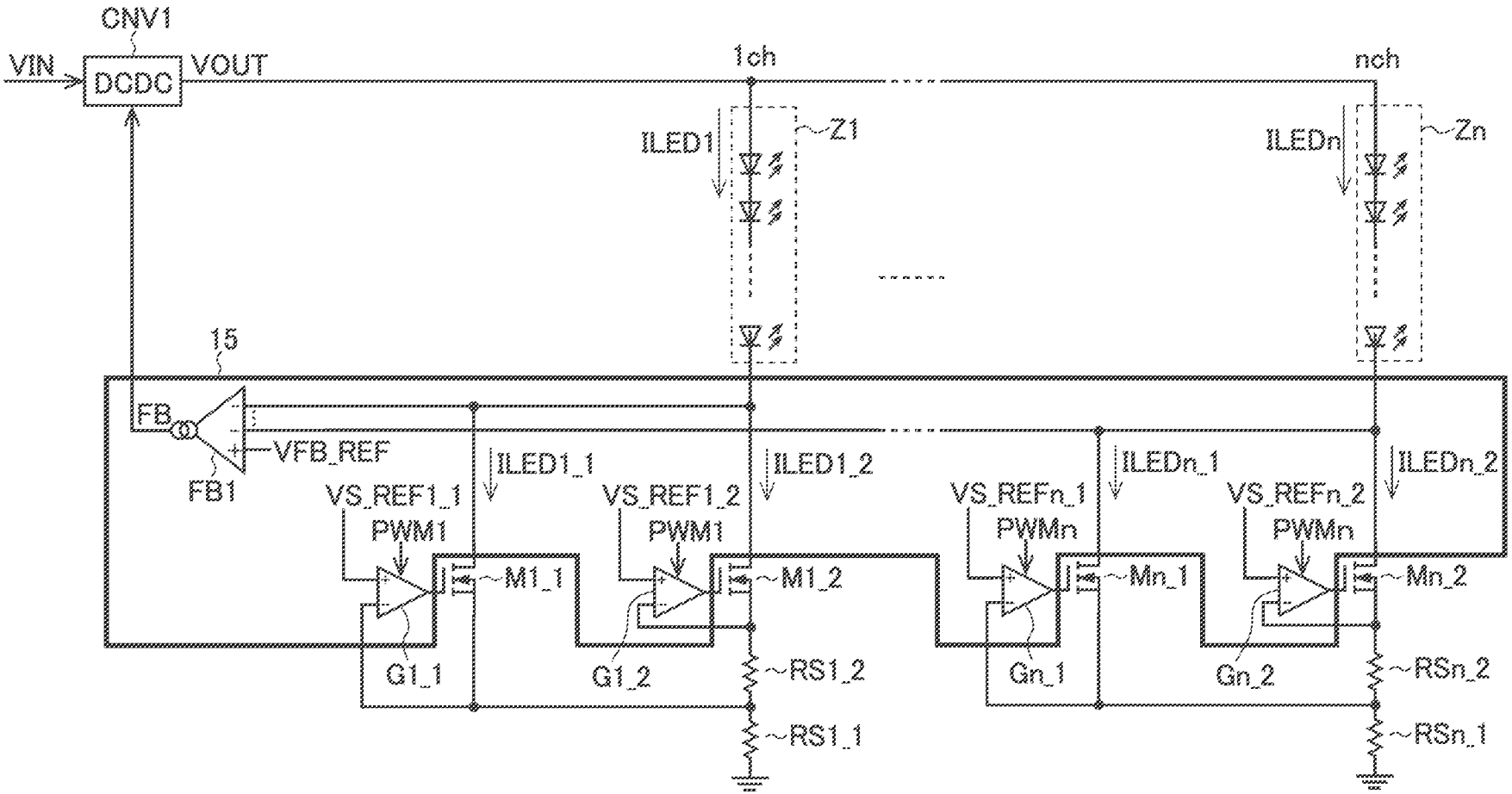
FIG. 11 is a diagram showing a fifth modified example of a light-emitting device.

The light-emitting device 105 shown in FIG. 11 includes an LED driving device 15. The LED driving device 15 differs from the LED driving device 10 in that it does not include the NMOS transistors M1_1 to Mn_1 and M1_2 to Mn_2. In the light-emitting device 105 shown in FIG. 11, the NMOS transistors M1_1 to Mn_1 and M1_2 to Mn_2 are components that are externally connected to the LED driving device 15, and this helps effectively restrain the rise in the temperature of the LED driving device 15 irrespective of the degree of variation among the cathode voltages of the LED strings in the different channels.

The modified examples described above can be implemented in an appropriate combination. For example, in a case where the second and fifth modified examples are implemented in combination, the resistors RS1_1 to RSn_1 and RS1_2 to RSn_2 are incorporated in the LED driving device, and the NMOS transistors M1_1 to Mn_1 and M1_2 to Mn_2 are components externally connected to the LED driving device.

Application to a Television Receiver: The light-emitting device described above can be used as, for example, a backlight in a liquid crystal display device. Examples of electronic appliances that include a liquid crystal display device include television receivers, monitors for personal computers, smartphones, and portable game machines.

Figure 5:
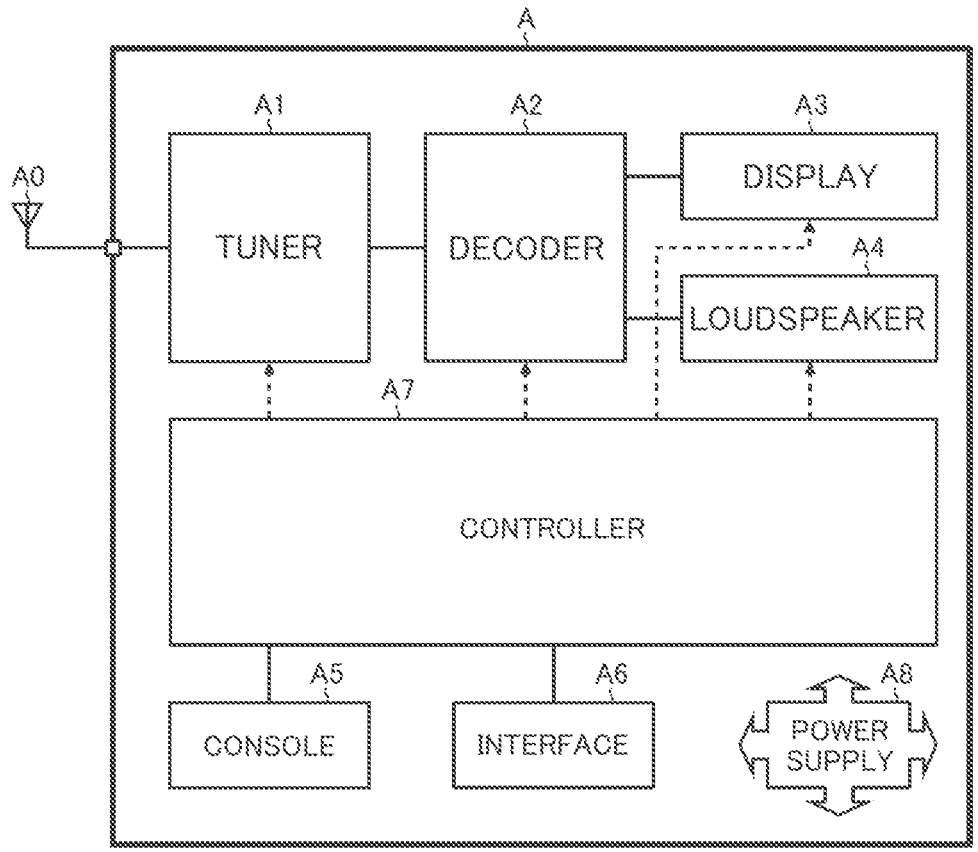
FIG. 5 is a block diagram showing one configuration example of a television receiver.
Figure 6A:
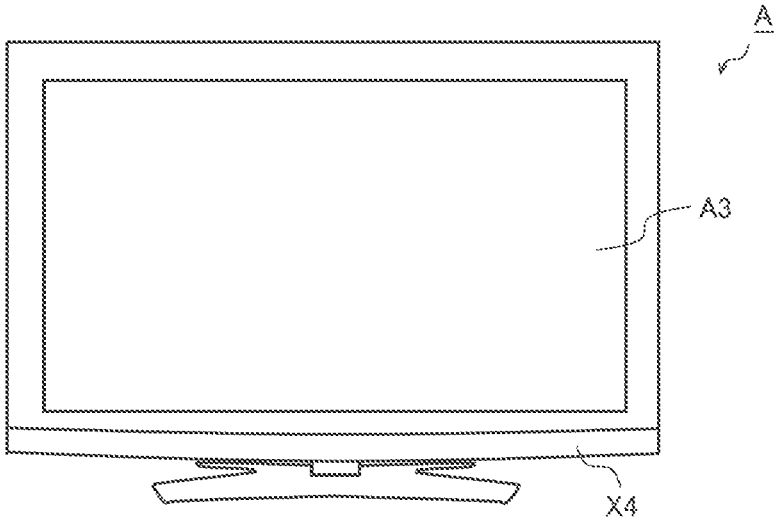
FIG. 6A is a front view of a television receiver.
Figure 6B:
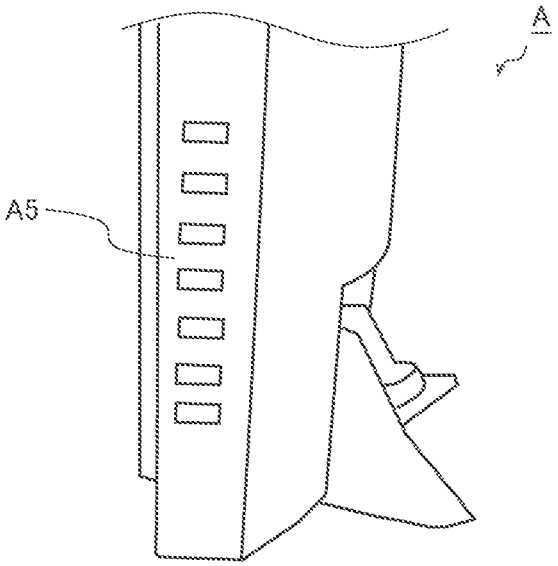
FIG. 6B is a side view of a television receiver.
Figure 6C:
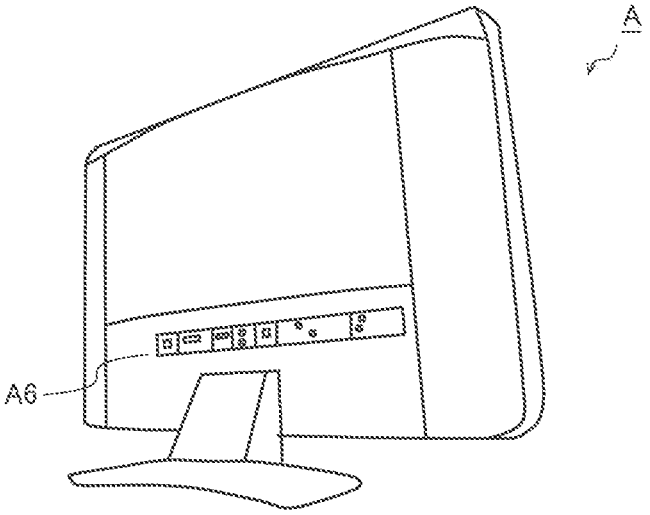
FIG. 6C is a rear view of a television receiver.

FIG. 5 is a block diagram showing one configuration example of a television receiver incorporating the light-emitting device described previously. FIGS. 6A to 6C are a front view, a side view, and a rear view, respectively, of a television receiver A incorporating the light-emitting device described previously. The television receiver A of this configuration example includes a tuner A1, a decoder A2, a display A3, a loudspeaker A4, a console A5, an interface A6, a controller A7, and a power supply A8.

The tuner A1 selects the broadcast signal of a desired channel from the reception signals received via an antenna A0 that is connected externally to the television receiver A.

The decoder A2 generates from the broadcast signal selected by the tuner A1 a video signal and an audio signal. The decoder A2 also has the function of generating a video signal and an audio signal from an external input signal from the interface A6.

The display A3 outputs the video reproduced from the video signal generated by the decoder A2. The display A3 includes the light-emitting device described previously.

The loudspeaker A4 outputs the audio reproduced from the audio signal generated by the decoder A2.

The console A5 is a kind of human interface that accepts user operation. Usable as the console A5 are, for example, buttons, switches, and a remote control unit.

The interface A6 is a front-end that receives an external input signal from an external device (such as an optical disc player and a hard disk drive).

The controller A7 controls the operation of the different parts A1 to A6 mentioned above in a comprehensive manner. Usable as the controller A7 is, for example, a CPU.

The power supply A8 supplies the different parts A1 to A6 mentioned above with electric power.

Modifications: In the embodiment described above, all the channels have the same configuration. Instead, some of the channels can be given, for example, a configuration similar to that of the light-emitting device 200 shown in FIG. 12. For example, the respective forward voltages of the LED strings are roughly grasped so that the LED strings are ranked according to their forward voltages; then LED strings with higher forward voltages can be given a configuration similar to that of the light-emitting device 200 shown in FIG. 12, or less frequently used LED strings can be given a configuration similar to that of the light-emitting device 200 shown in FIG. 12.

The embodiment described above deals with, as an example, a configuration where LEDs are used as light-emitting elements. This, however, is not meant to limit the implementation of the present invention. Instead, for example, organic EL elements can be used as light-emitting elements.

The various technical features disclosed in the present specification can be implemented in any manner other than specifically described by way of embodiments above, and allow for many modifications within the spirit of the technical ingenuity involved. That is, it should be understood that the embodiments disclosed in the present specification are in every aspect illustrative and not restrictive, and that the technical scope of the present invention is defined not by the description of embodiments given above but by the scope of the appended claims and encompasses any modifications in a sense and scope equivalent to those of the claims.

Overview: According to one aspect of what is disclosed in the present specification, a light-emitting element driving device configured to drive a plurality of light-emitting element strings each composed of at least one light-emitting element includes: a first amplifier configured, with respect to each of the plurality of light-emitting element strings, to control a first transistor connected in series with the light-emitting element string based on the current passing through the light-emitting element string; and a second amplifier configured, with respect to each of at least part of the plurality of light-emitting element strings, to control a second transistor, which is included in a series circuit composed of the second transistor and a first resistor and connected in parallel with the first transistor, based on the current passing through the light-emitting element string and g current passing through the second transistor. (A first configuration.)

In the light-emitting element driving device of the first configuration described above, preferably, with respect to each of at least part of the plurality of light-emitting element strings, the first resistor is connected to the light-emitting element string via the second transistor. (A second configuration.)

In the light-emitting element driving device of the first or second configuration described above, preferably, the second amplifier is provided with respect to each of the plurality of light-emitting element strings. (A third configuration.)

In the light-emitting element driving device of any the first to third configurations described above, preferably, with respect to each of the plurality of light-emitting element strings, a second resistor is provided that is configured such that a current equivalent to the current passing through the light-emitting element string passes through the second resistor. (A fourth configuration.)

In the light-emitting element driving device of the fourth configuration described above, preferably, the first resistor is provided with respect to each of at least part of the plurality of light-emitting element strings. (A fifth configuration.)

In the light-emitting element driving device of any the first to fifth configurations described above, preferably, the first transistor is provided with respect to each of the plurality of light-emitting element strings, and the second transistor is provided with respect to each of at least part of the plurality of light-emitting element strings. (A sixth configuration.)

In the light-emitting element driving device of any the first to fifth configurations described above, preferably, the first transistor is provided with respect to each of the plurality of light-emitting element strings and the second transistor is not provided with respect to any of at least part of the plurality of light-emitting element strings, or the first transistor is not provided with respect to any of the plurality of light-emitting element strings and the second transistor is provided with respect to each of at least part of the plurality of light-emitting element strings. (A seventh configuration.)

According to another aspect of what is disclosed in the present specification, a light-emitting device includes: the light-emitting element driving device of any of the first to seventh configurations described above; and the plurality of light-emitting element strings. (An eighth configuration.)

In the light-emitting device of the eighth configuration described above, preferably, the first resistor is incorporated in or externally connected to the light-emitting element driving device with respect to each of at least part of the plurality of light-emitting element strings, and a second resistor is incorporated in or externally connected to the light-emitting element driving device with respect to each of the plurality of light-emitting element strings and is configured such that a current equivalent to the current passing through the light-emitting element string passes through the second resistor. With respect to each of at least part of the plurality of light-emitting element strings, the first and second resistors have substantially equal resistance values. (A ninth configuration.)

According to yet another aspect of what is disclosed in the present specification, an electronic appliance includes: the light-emitting device of the eighth or ninth configuration described above. (A tenth configuration.)

What is claimed is:

1. A light-emitting element driving device configured to drive a plurality of light-emitting element strings each composed of at least one light-emitting element, the light-emitting element driving device comprising: a first amplifier configured, with respect to each of the plurality of light-emitting element strings, to control a first transistor connected in series with the light-emitting element string based on a current passing through the light-emitting element string; and a second amplifier configured, with respect to each of at least part of the plurality of light-emitting element strings, to control a second transistor, which is included in a series circuit composed of the second transistor and a first resistor and connected in parallel with the first transistor, based on the current passing through the light-emitting element string and a current passing through the second transistor, wherein the first and second amplifiers are configured to control the first and second transistors respectively such that, with respect to each of at least part of the plurality of light-emitting element strings, as a current passing through the first transistor increases, the current passing through the second transistor decreases, and conversely, as the current passing through the first transistor decreases, the current passing through the second transistor increases.

2. The light-emitting element driving device according to claim 1, where m with respect to each of at least part of the plurality of light-emitting element strings, the first resistor is connected to the light-emitting element string via the second transistor.

3. The light-emitting element driving device according to claim 1, wherein the second amplifier is provided with respect to each of the plurality of light-emitting element strings.

4. The light-emitting element driving device according to claim 1, wherein with respect to each of the plurality of light-emitting element strings, a second resistor is provided that is configured such that a current equivalent to the current passing through the light-emitting element string passes through the second resistor.

5. The light-emitting element driving device according to claim 4, wherein the first resistor is provided with respect to each of at least part of the plurality of light-emitting element strings.

6. The light-emitting element driving device according to claim 1, wherein the first transistor is provided with respect to each of the plurality of light-emitting element strings, and the second transistor is provided with respect to each of at least part of the plurality of light-emitting element strings.

7. The light-emitting element driving device according to claim 1, wherein the first transistor is provided with respect to each of the plurality of light-emitting element strings and the second transistor is not provided with respect to any of at least part of the plurality of light-emitting element strings, or the first transistor is not provided with respect to any of the plurality of light-emitting element strings and the second transistor is provided with respect to each of at least part of the plurality of light-emitting element strings.

8. A light-emitting device comprising: the light-emitting element driving device according to claim 1; and the plurality of light-emitting element strings.

9. The light-emitting device according to claim 8, wherein the first resistor is incorporated in or externally connected to the light-emitting element driving device with respect to each of at least part of the plurality of light-emitting element strings, a second resistor is incorporated in or externally connected to the light-emitting element driving device with respect to each of the plurality of light-emitting element strings and configured such that a current equivalent to the current passing through the light-emitting element string passes through the second resistor, and with respect to each of at least part of the plurality of light-emitting element strings, the first and second resistors have substantially equal resistance values.

10. An electronic appliance comprising: the light-emitting device according to claim 8.

* * * * *